US007658649B2

(12) United States Patent
Satoh et al.

(10) Patent No.: US 7,658,649 B2
(45) Date of Patent: Feb. 9, 2010

(54) CARD CONNECTOR MECHANISM AND CARD ADAPTER HAVING THE CARD CONNECTOR MECHANISM

(75) Inventors: Kazuki Satoh, Miyagi-ken (JP); Toru Wagatsuma, Miyagi-ken (JP); Takashi Kawahata, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/720,309

(22) PCT Filed: Nov. 28, 2005

(86) PCT No.: PCT/JP2005/021768

§ 371 (c)(1),
(2), (4) Date: May 25, 2007

(87) PCT Pub. No.: WO2006/057380

PCT Pub. Date: Jun. 1, 2006

(65) Prior Publication Data

US 2009/0280657 A1 Nov. 12, 2009

(30) Foreign Application Priority Data

Nov. 29, 2004 (JP) ..... 2004-344465

(51) Int. Cl.
*H01R 24/00* (2006.01)

(52) U.S. Cl. ..... 439/630; 439/638

(58) Field of Classification Search ..... 439/630, 439/638

See application file for complete search history.

(56) References Cited

U.S. PATENT DOCUMENTS

| | | | | |
|---|---|---|---|---|
| 5,667,408 | A * | 9/1997 | Broschard et al. | 439/630 |
| 6,282,099 | B1 * | 8/2001 | Wilson et al. | 361/753 |
| 6,413,109 | B1 * | 7/2002 | Kobayashi et al. | 439/326 |
| 6,511,350 | B1 * | 1/2003 | Ito et al. | 439/680 |

FOREIGN PATENT DOCUMENTS

| | | |
|---|---|---|
| JP | 50-8058 | 1/1975 |
| JP | 177884/1989 | 12/1989 |
| JP | 54184/1990 | 4/1990 |
| JP | 8-96089 | 4/1996 |
| JP | 2003-223956 | 8/2003 |
| WO | WO 98/52139 | 11/1998 |

OTHER PUBLICATIONS

Search Report dated Jan. 24, 2006 for International Application No. PCT/JP2005/021768.

* cited by examiner

*Primary Examiner*—Truc T Nguyen
(74) *Attorney, Agent, or Firm*—Brinks Hofer Gilson & Lione

(57) ABSTRACT

A connector mechanism for a card, capable of being thinned, and a card adaptor having a connector mechanism for a card. A connector mechanism for a card, having an installation section (2*a*) in which a card (1) having external connection sections is installed and having a terminal member (9) with which the external connection sections of the card (1) can come into contact. The mechanism further has a lift-up mechanism including a projection section (2*b*) that once lift a front end section (1*a*) of the card (1) upward and then causes each of the external connection sections of the card (1) to be in contact with a corresponding one of the terminals (9*a*-9*c*) of the terminal member (9).

6 Claims, 8 Drawing Sheets

CARD CONNECTOR MECHANISM AND CARD ADAPTER HAVING THE CARD CONNECTOR MECHANISM

This is a nationalization of PCT/JP2005/021768, filed Nov. 28, 2005, which claims priority to Japanese Patent Application No. 2004-344465, filed Nov. 29, 2004, the entirety of both of which are incorporated herein by reference.

TECHNICAL FIELD

The present invention relates to card connector mechanisms equipped in electronic apparatuses, and to card adapters having card connector mechanisms.

BACKGROUND ART

There are various known types of connector devices equipped with a connector mechanism having a terminal member contactable with an external connection portion of a card, and various known types of card adapters mountable to a connector device and equipped with a connector mechanism having a terminal member contactable with an external connection portion of a card.

Patent Document 1 discloses an example of a card adapter having a connector mechanism, and Patent Document 2 discloses an example of a connector device having a connector mechanism.

As a structure of a terminal member equipped in a connector mechanism, Patent Document 2 discusses a cantilevered terminal member that is supported at its posterior end. To prevent the terminal member from buckling in the course of insertion of the card, this terminal member is designed such that a free end portion thereof proximate to the insertion side of the card is given an angular shape and has a relatively long, flared guide for guiding an anterior end of the card, which is the inserting end.

Patent Document 1: Japanese Unexamined Patent Application Publication No. 2000-40131

Patent Document 2: Japanese Unexamined Patent Application Publication No. 2001-143816

DISCLOSURE OF INVENTION

Problems to be Solved by the Invention

The card adapter disclosed in Patent Document 1 is generally given the same shape as that of a card insertable to a connector device to which the card adapter can be mounted. This implies that if the card insertable to the connector device is reduced in thickness, it will be necessary to also reduce the thickness of the card adapter.

However, if the terminal member provided in the connector mechanism of the card adapter has a cantilevered structure and the free end portion of the terminal member has a relatively long, flared guide for guiding the anterior end of the card as in Patent Document 2, a large vertical bending space for the guide is necessary. This makes the thickness reduction of the card adapter difficult.

In view of the circumstances described above, it is an object of the present invention to provide a low-profile card connector mechanism and a card adapter having the card connector mechanism.

Means for Solving the Problems

In order to achieve the aforementioned object, the present invention provides a card connector mechanism that includes a holder portion for holding a card having an external connection portion, and a cantilevered terminal member supported at a posterior end thereof. The external connection portion of the card is contactable with the terminal member. The card connector mechanism further includes a lifting mechanism that temporarily lifts up an anterior end of the card defining an inserting end thereof during insertion of the card, and then brings the external connection portion of the card into contact with the terminal member.

Accordingly, in the card connector mechanism of the present invention, during insertion of the card, the lifting mechanism temporarily lifts the anterior end of the card upward so as to prevent the anterior end of the inserted card from abutting on the free end of the cantilevered terminal member. In other words, the free end of the terminal member does not require a flared guide as in the related art, whereby the free end of the terminal member can be reduced in size in the vertical direction. Thus, the bending space in the vertical direction for the movement of the free end of the terminal member can be dimensionally reduced, whereby the device can be reduced in thickness.

Furthermore, in the card connector mechanism according to the present invention, the card has cutouts on opposite side edges thereof. Moreover, the lifting mechanism includes protrusions provided on left and right sides of a bottom surface of the holder portion, and a bottom of the card. During insertion of the card, the bottom of the card abuts on the protrusions so that the anterior end of the card is lifted upward, the anterior end subsequently moving downward as a result of engagement between the cutouts of the card and the protrusions so that the external connection portion of the card comes into contact with the terminal member. Accordingly, in the connector mechanism of the present invention, the lifting mechanism can be realized with a simple configuration having simply the protrusions on the left and right sides of the bottom surface of the holder portion in which the card can be held.

Furthermore, the present invention also provides a card adapter that includes the aforementioned card connector mechanism. The card adapter of the present invention having this configuration can be entirely reduced in thickness in correspondence to a low-profile structure of a card insertable to a connector device.

Furthermore, in the card adapter of the present invention, the terminal member includes a ground terminal. Moreover, the card adapter further includes a metallic cover member that is vertically movable and covers the card held in the holder portion, and a metallic spring segment that biases the cover member downward. The metallic spring segment is connected to the ground terminal. In the card adapter of the present invention having this configuration, during insertion of the card, when the lifting mechanism lifts the anterior end of the card upward, the anterior end of the card causes the cover member to move upward against a bias force of the spring segment. When the card is held in the holder portion, the cover member moves downward due to the bias force of the spring segment so as to restrict the upward movement of the card held in the holder portion. Furthermore, the metallic cover member is connected to the ground terminal through the spring segment, thereby achieving electrical protection of the card held in the holder portion.

Advantages

The card connector mechanism according to the present invention is provided with a lifting mechanism which temporarily lifts the anterior end of the card upward during insertion of the card and then brings the external connection portion of the card into contact with the cantilevered terminal member. Thus, the card can be held in the holder portion without requiring a flared guide on the free end of the terminal member as in the related art. Accordingly, the terminal member can be reduced in size in the vertical direction. Thus, the bending space in the vertical direction for the movement of the free end of the terminal member can be dimensionally reduced, whereby the device can be reduced in thickness.

The card adapter of the present invention that includes the aforementioned card connector mechanism can be entirely reduced in thickness in correspondence to a low-profile structure of a card insertable to a connector device.

BEST MODE FOR CARRYING OUT THE INVENTION

Embodiments of a card connector mechanism and a card adapter having the card connector mechanism according to the present invention will now be described with reference to the drawings.

FIG. 1 is a perspective view showing a card adapter having a card connector mechanism according to an embodiment of the present invention and a card used in the present embodiment. FIG. 2 includes part (a) which is a perspective view showing a state where a cap defining an upper side is disassembled from the state shown in FIG. 1, and part (b) which is an enlarged view of section A in part (a). FIG. 3 is a perspective view showing a state where a cover member disposed below the cap and an insert-molded body including a terminal member are disassembled from the state shown in part (a) of FIG. 2. FIG. 4 includes part (a) which is a plan view showing a pre-inserted state of the card used in the present embodiment, and part (b) which is a cross-sectional view taken along line B-B in part (a). FIG. 5 includes part (a) which is a plan view showing a state where the cover member is removed from the state shown in part (a) of FIG. 4, and part (b) which is a cross-sectional view taken along line C-C in part (a).

[Configuration of the Card]

As shown in FIGS. 1 to 5, a card 1 to be used in a card adapter having a card connector mechanism according to an embodiment of the present invention to be described hereinafter has an anterior end 1*a*, which is an inserting end, and an ejecting-side end surface 1*b* at a position opposite to the anterior end 1*a*. Excluding the end surface 1*b*, the card 1 has step portions 1*c* along opposite side edges thereof. The step portions 1*c* on the opposite side edges are provided with cutouts 1*d*. A bottom 1*e* is a substantially flat surface. The bottom 1*e* is provided with a plurality of external connection portions used for sending and receiving of signals.

[Basic Configuration of the Card Adapter of the Present Embodiment]

As shown in FIGS. 1 and 2, the card adapter according to the present embodiment includes a base 2 formed of resin and a cap 3 defining an upper side of the base 2. The base 2 and the cap 3 constitute a housing into which the card 1 can be inserted.

As shown in FIGS. 2 and 3, the base 2 has an insertion slot 4 through which the card 1 can be inserted. The insertion slot 4 is defined by a rigid frame 5 formed integrally with the base 2 using the same resin. In other words, this frame 5 forms the insertion slot 4 for the card 1. The lower ends of the frame 5 are provided with guides 6 for guiding the step portions 1*c* of the card 1.

An area of the base 2 adjacent to the insertion slot 4 is provided with a holder portion 2*a* for holding the card 1. As shown in FIG. 5, the opposite sides of the bottom surface of the holder portion 2*a* are integrally provided with a pair of protrusions 2*b*.

As shown in part (b) of FIG. 5, each protrusion 2*b* has a tapered section 2*b*1 at a side thereof that is proximate to the insertion slot 4. The tapered section 2*b*1 is inclined at a moderate angle. On the other hand, the side of each protrusion 2*b* that is proximate to the interior of the device is provided with a stopper section 2*b*2, which is inclined at a sharp angle.

Specifically, the present embodiment is equipped with a lifting mechanism which temporarily lifts the anterior end 1*a* of the card 1 upward during insertion of the card 1 and then brings the external connection portions provided on the bottom 1*e* of the card 1 into contact with a terminal member 9 to be described hereinafter. This lifting mechanism is constituted by the protrusions 2*b* and the bottom 1*e* of the card 1.

Furthermore, as shown in FIGS. 2 and 3, the present embodiment is provided with a metallic cover member 7 which covers the card 1 held by the holder portion 2*a* of the base 2 and can move upward to allow the card 1 held in the holder portion 2*a* to be ejectable. The cover member 7 is rotatably attached to, for example, shafts 5*a* provided at the opposite ends of the frame 5. The cover member 7 is provided with protruding segments 7*a* on the opposite side edges thereof.

As shown in FIG. 3, in the present embodiment, an insert-molded body 8 is disposed adjacent to the holder portion 2*a* of the base 2. The insert-molded body 8 includes a terminal member 9 having, for example, a ground terminal 9*a*, a power terminal 9*b*, and a plurality of signal terminals 9*c*, metallic spring segments 10 connected to the ground terminal 9*a* and biasing the cover member 7 downward through the protruding segments 7*a*, and a plurality of external connection terminals 11 that are connected to the corresponding terminals 9*a* to 9*c* included in the terminal member 9 and are contactable with a terminal member of a connector device 12 to which the card adapter according to the present embodiment can be mounted.

In view of achieving safe signal processing, the ground terminal 9*a* and the power terminal 9*b* included in the terminal member 9 are, for example, made longer than the remaining signal terminals 9*c*. Consequently, during insertion of the card 1, the ground terminal 9*a* and the power terminal 9*b* come into contact with the external connection portions of the card 1 before the signal terminals 9*c* come into contact with the external connection portions. On the other hand, during ejection of the card 1, the ground terminal 9*a* and the power terminal 9*b* come out of contact with the external connection portions of the card 1 after the signal terminals 9*c* come out of contact with the external connection portions.

The free ends of the ground terminal 9*a*, the power terminal 9*b*, and the signal terminals 9*c* included in the terminal member 9, namely, the sections that come into contact with the external connection portions of the card 1, are given a small angular shape but do not have guides for guiding the anterior end 1*a* of the card 1.

The holder portion 2*a*, including the protrusions 2*b* of the base 2, and the terminal member 9 of the insert-molded body 8 constitute the card connector mechanism equipped in the card adapter according to the present embodiment.

In a state where the card adapter of the present embodiment is connected to a connector device 12 to be described hereinafter, the present embodiment is provided with restricting means for restricting the upward movement of the cover member 7. This restricting means is defined by, for example, the connector device 12 to be described below.

When the card 1 is held in the holder portion 2*a*, the protrusions 2*b* provided on the opposite sides of the bottom surface of the holder portion 2*a* of the base 2 are engaged with the cutouts 1*d* on the opposite side edges of the card 1. Thus, the protrusions 2*b* also function as retainer protrusions for the card 1. In other words, in addition to being components that constitute the lifting mechanism described above, these protrusions 2*b* also serve as retainer members for the card 1.

[Operation of Inserting the Card into the Card Adapter of the Present Embodiment]

FIG. 6 includes part (a) which is a plan view showing a state where the card is in the process of being inserted into the present embodiment, and part (b) which is a cross-sectional view taken along line D-D in part (a). FIG. 7 is an enlarged view of section E in FIG. 6. FIG. 8 includes part (a) which is a plan view showing a state where the card held in the holder portion of the present embodiment is locked, and part (b) which is a cross-sectional view taken along line F-F in part (a).

When the card 1 is inserted into the insertion slot 4 in the card adapter of the present embodiment from the pre-inserted state of the card 1 shown in FIGS. 4 and 5, the step portions 1*c* along the opposite side edges of the card 1 are guided by the guides 6 provided at the lower sections of the frame 5 shown in FIGS. 2 and 3. As a results the card 1 moves into the device as shown in FIG. 6. In addition, the anterior end 1*a* of the card 1 is guided by the tapered sections 2*b*1 of the protrusions 2*b* provided on the opposite sides of the bottom surface of the holder portion 2*a* so as to be lifted upward temporarily. In response to this, the cover member 7 rotates upward against the bias force of the spring segments 10 shown in FIGS. 2 and 3. Because the anterior end 1*a* of the card 1 is lifted upward in this manner, the anterior end 1*a* of the card 1 can move into the device without abutting on the free ends of the terminals 9*a* to 9*c* of the terminal member 9. Subsequently, for example, when the central area of the card 1 has passed through the protrusions 2*b*, the anterior end 1*a* of the card 1 is rotated downward. In this state, the card 1 is pushed inward until reaching a predetermined holding position in the holder portion 2*a*.

After the anterior end 1*a* of the card 1 is rotated downward, the external connection portions on the bottom 1*e* of the card 1 are brought into contact with the corresponding terminals 9*a* to 9*c* of the terminal member 9. In addition, the protrusions 2*b* in the holder portion 2*a* are brought into engagement with the corresponding cutouts 1*d* on the opposite side edges of the card 1. During this time, the cover member 7 has its protruding segments 7*a* biased by the spring segments 10, whereby the cover member 7 is, for example, rotated downward until the top surface thereof is flush with the top surface of the cap 3. When the card 1 is held at the predetermined holding position, the device becomes connectable to the connector device 12*r* as shown with a two-dot chain line in part (b) of FIG. 8.

Consequently, when the card adapter of the present embodiment holding the card 1 in this manner is pushed into the connector device 12 to a predetermined mounting position thereof as shown in part (b) of FIG. 8, the external connection terminals 11 in the present embodiment become connected to corresponding terminal members of the connector device 12. Accordingly, this allows for sending and receiving of signals between the card 1 and the connector device 12 through the card adapter of the present embodiment.

In a state where the card adapter of the present embodiment holding the card 1 is mounted at a predetermined mounting position of the connector device 12 as shown in part (b) of FIG. 8, the connector device 12 restricts the upward rotation of the cover member 7. This implies that the anterior end 1*a* of the card 1 cannot be lifted upward. Therefore, even if one tries to pull out the card 1 in this state, the card 1 cannot ejected because the edges of the cutouts 1*d* of the card 1 are retained by the stopper sections 2*b*2 of the protrusions 2*b*. In other words, the card 1 is held in a state where it is retained by the protrusions 2*b*.

[Operation of Ejecting the Card from the Card Adapter of the Present Embodiment]

For example, when the card adapter of the present embodiment is pulled out from the state shown in part (b) of FIG. 8 in which the card adapter of the present embodiment holding the card 1 is connected to the connector device 12, the cover member 7 becomes free of the restriction by the connector device 12 and thus becomes rotatable in the upward direction. Consequently, the card 1 can be pulled out of the card adapter of the present embodiment. In this case, as the card 1 is pulled out, the protrusions 2*b* temporarily lift the anterior end 1*a* of the card 1 upward, causing the cover member 7 to rotate upward against the bias force of the spring segments 10. As a result, the card 1 can be ejected through the insertion slot 4.

ADVANTAGES OF THE PRESENT EMBODIMENT

In the connector mechanism equipped in the card adapter of the present embodiment having the above-described configuration, during insertion of the card 1, the lifting mechanism constituted by the protrusions 2*b* temporarily lifts the anterior end 1*a* of the card 1 upward so as to prevent the anterior end 1*a* of the card 1 from abutting on the free ends of the cantilevered terminals 9*a* to 9*c* included in the terminal member 9. Thus, as mentioned above, the terminals 9*a* to 9*c* of the terminal member 9 do not require flared guides for guiding the anterior end 1*a* of the card 1. Accordingly, the free ends of the terminals 9*a* to 9*c* of the terminal member 9 can be reduced in size in the vertical direction, whereby the bending space in the vertical direction for the movement of the free ends of terminals 9*a* to 9*c* included in the terminal member 9 can be dimensionally reduced.

Thus, the vertical dimension of the card adapter according to the present embodiment can be reduced, whereby the card adapter can be entirely reduced in thickness in correspondence to a low-profile structure of the card 1.

Furthermore, in the connector mechanism equipped in the card adapter of the present embodiment, the lifting mechanism can be realized with a simple configuration having simply the protrusions 2*b* on the left and right sides of the bottom surface of the holder portion 2*a* in which the card 1 can be held. This contributes to lower manufacturing costs.

In the card adapter of the present embodiment, the spring segments 10 bias the cover member 7 downward, thereby restricting the upward movement of the card 1 held in the holder portion 2*a*. Furthermore, the cover member 7 is connected to the ground terminal 9*a* of the terminal member 9 through the spring segments 10, thereby achieving electrical protection of the card 1 held in the holder portion 2*a*.

When the card adapter of the present embodiment is connected to the connector device 12 in a state where the card adapter is holding the card 1, the connector device 12 restricts the upward rotation of the cover member 7. Therefore, even if one tries to pull out the card 1, the protrusions 2*b* prevent the card 1 from being ejected. Consequently, the card 1 cannot be ejected, thereby preventing the signal processing function from being damaged.

The protrusions 2*b* in the holder portion 2*a* serve both as the lifting mechanism and the retainer members for the card 1. This contributes to a reduced number of components as well as lower manufacturing costs.

The guides 6 conforming to the step portions 1*c* along the opposite side edges of the card 1 prevent the card 1 from being inserted upside-down or being inserted from its wrong end, thereby preventing erroneous insertion of the card 1.

Since the insertion slot 4 is defined by a rigid frame 5, the card 1 held in the holder portion 2*a* through the frame 5 can be retained tightly, thereby achieving a highly reliable device.

OTHER EMBODIMENTS OF THE PRESENT INVENTION

Although the above-described embodiment is directed to a connector mechanism equipped in a card adapter, the present invention is not limited to such a connector mechanism equipped in a card adapter, and may alternatively be applied to a connector mechanism equipped in a connector device 12. If the connector mechanism is applied to the connector device 12, the connector device 12 can be reduced in thickness.

Furthermore, in the above embodiment, the ground terminal 9*a* and the power terminal 9*b* of the terminal member 9 are made longer than the remaining signal terminals 9*c*. However, since the card 1 becomes non-ejectable in a state where the card adapter of the above embodiment holding the card 1 is connected to the connector device 12, there is no risk of damaging of the signal processing function due to ejection of the card 1. Accordingly, the ground terminal 9*a* and the power terminal 9*b* of the terminal member 9 may alternatively be given the same length as the remaining signal terminals 9*c*. Giving the ground terminal 9*a* and the power terminal 9*b* the same length as the remaining signal terminals 9*c* facilitates the manufacturing process of the insert-molded body 8 including the terminal member 9.

REFERENCE NUMERALS

Figure 1:
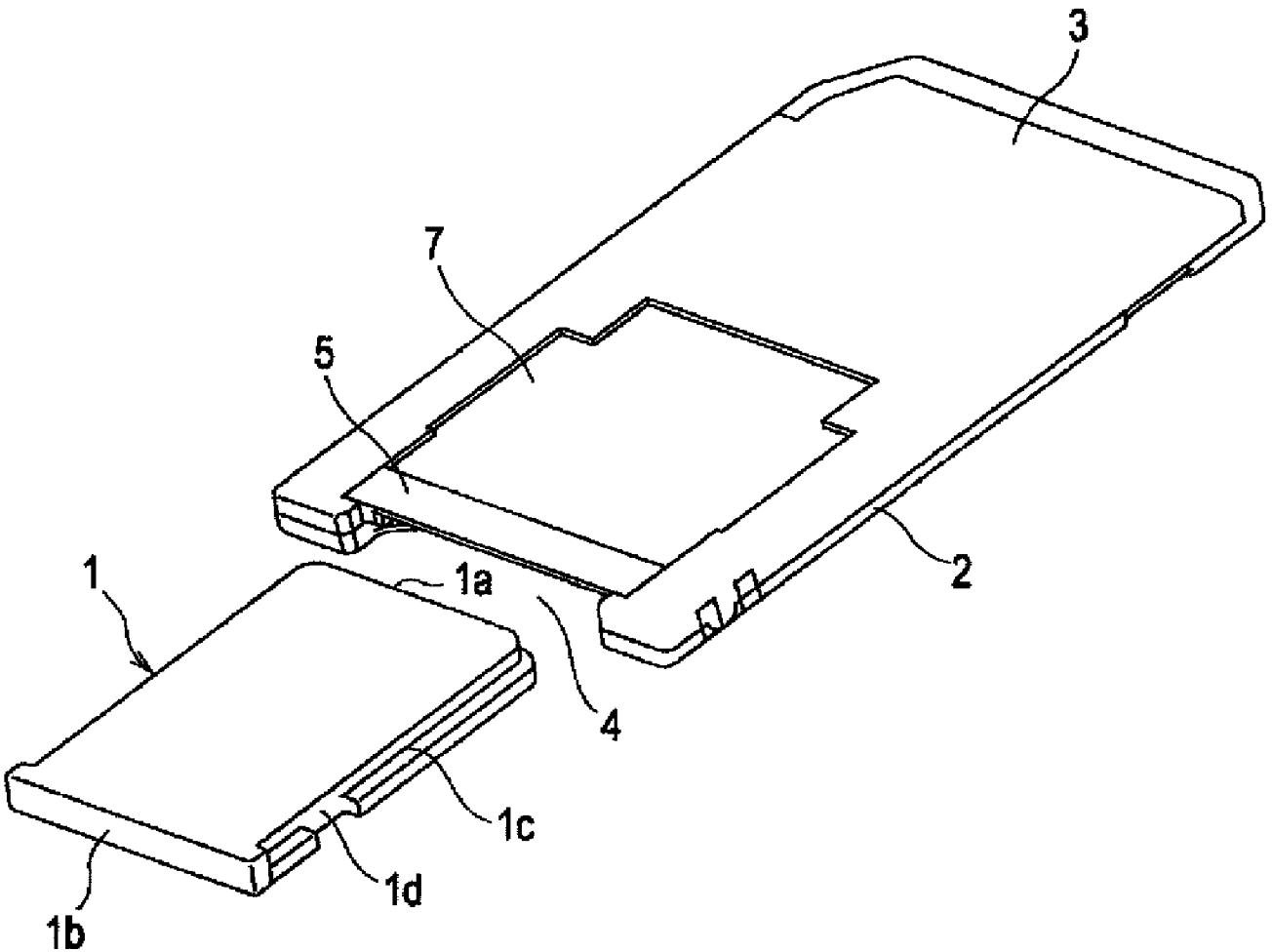
FIG. 1 is a perspective view showing a card adapter having a card connector mechanism according to an embodiment of the present invention and a card used in the present embodiment.
Figure 2:
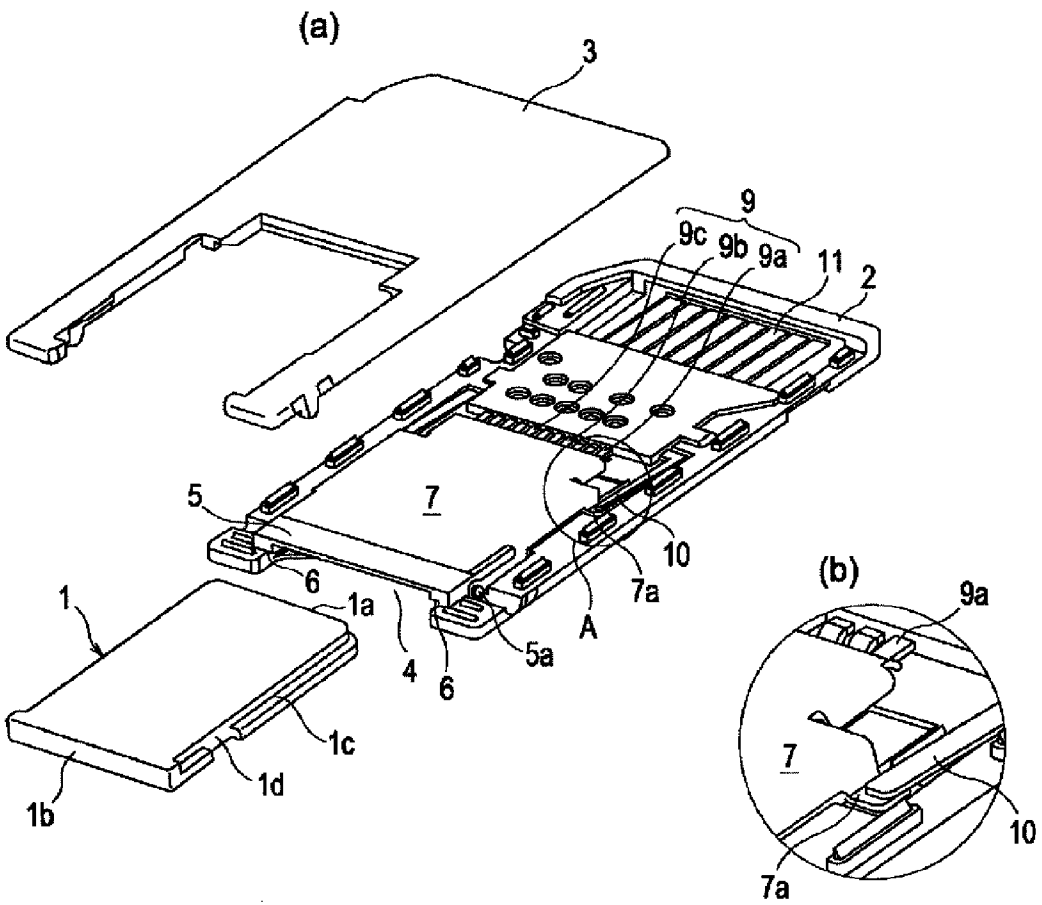
FIG. 2 includes part (a) which is a perspective view showing a state where a cap defining an upper side is disassembled from the state shown in FIG. 1, and part (b) which is an enlarged view of section A in part (a).
Figure 3:
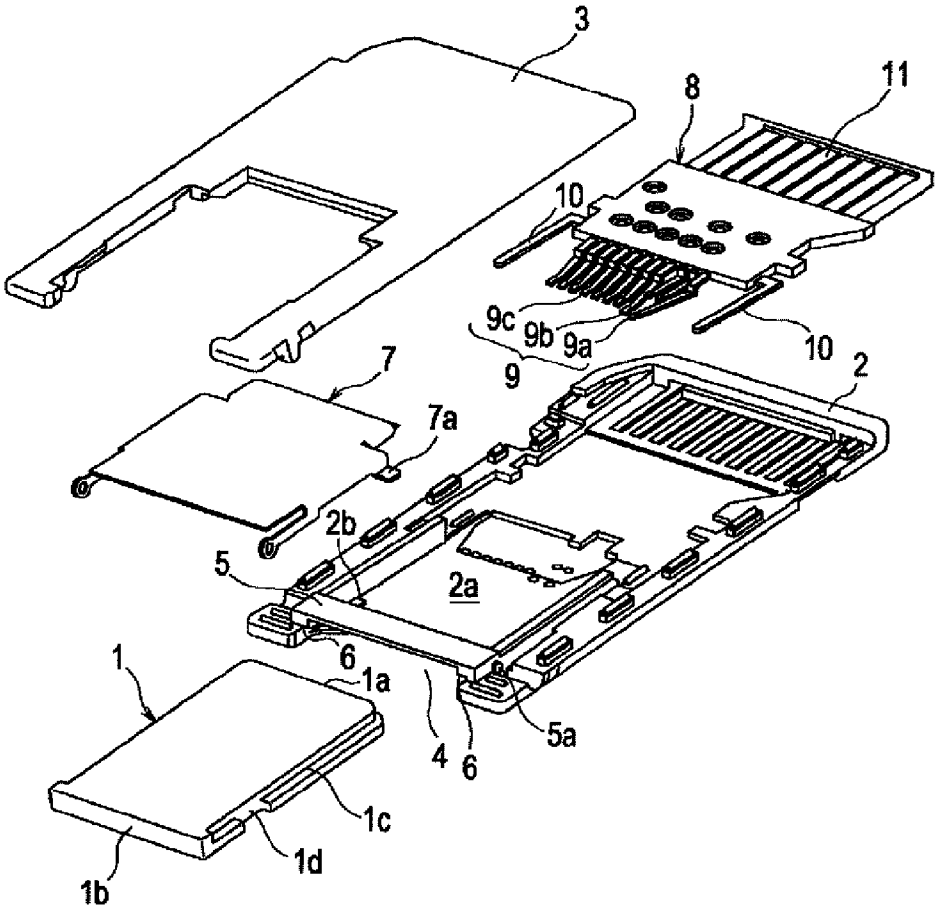
FIG. 3 is a perspective view showing a state where a cover member disposed below the cap and an insert-molded body including a terminal member are disassembled from the state shown in part (a) of FIG. 2.
Figure 4:
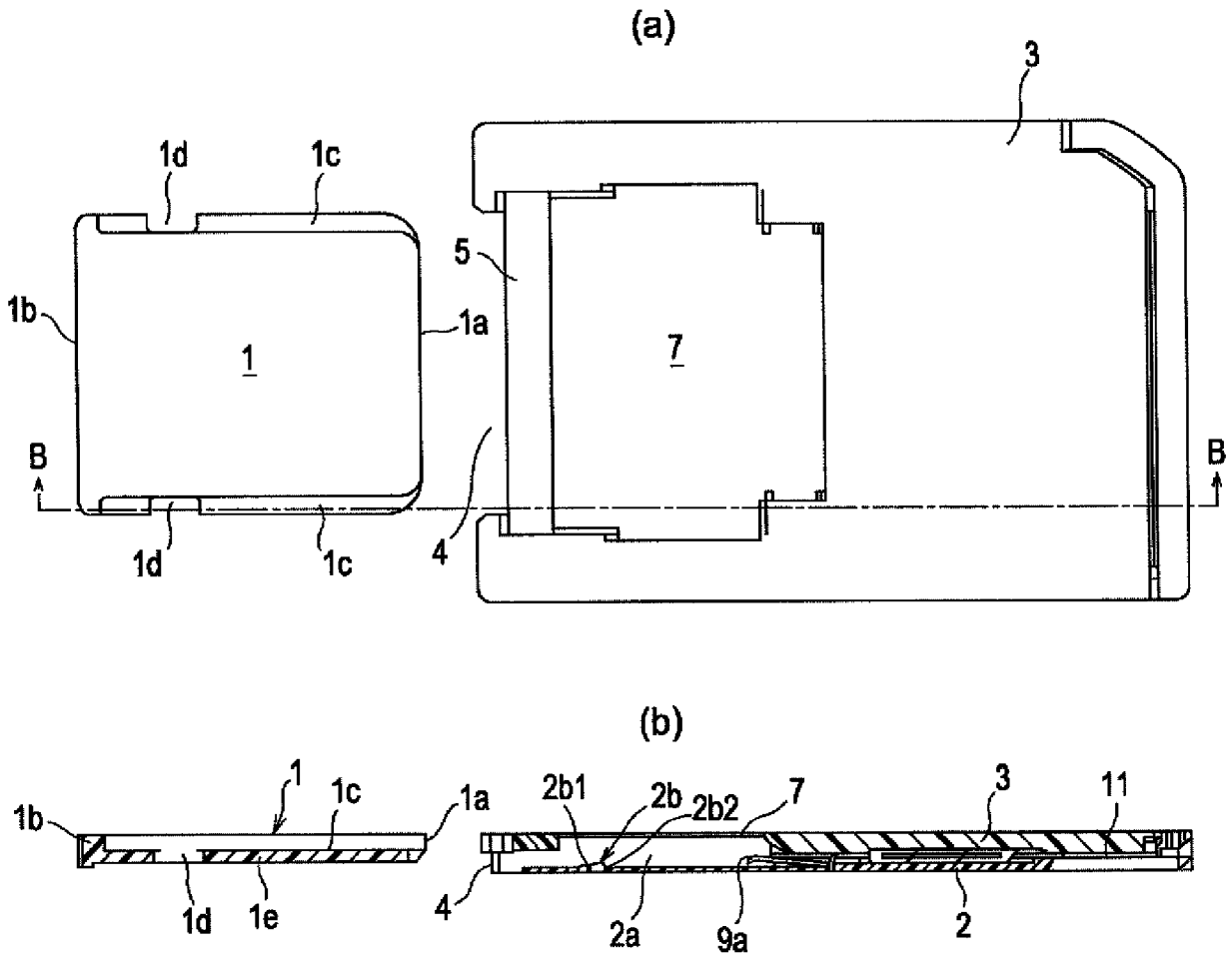
FIG. 4 includes part (a) which is a plan view showing a pre-inserted state of the card used in the present embodiment, and part (b) which is a cross-sectional view taken along line B-B in part (a).
Figure 5:
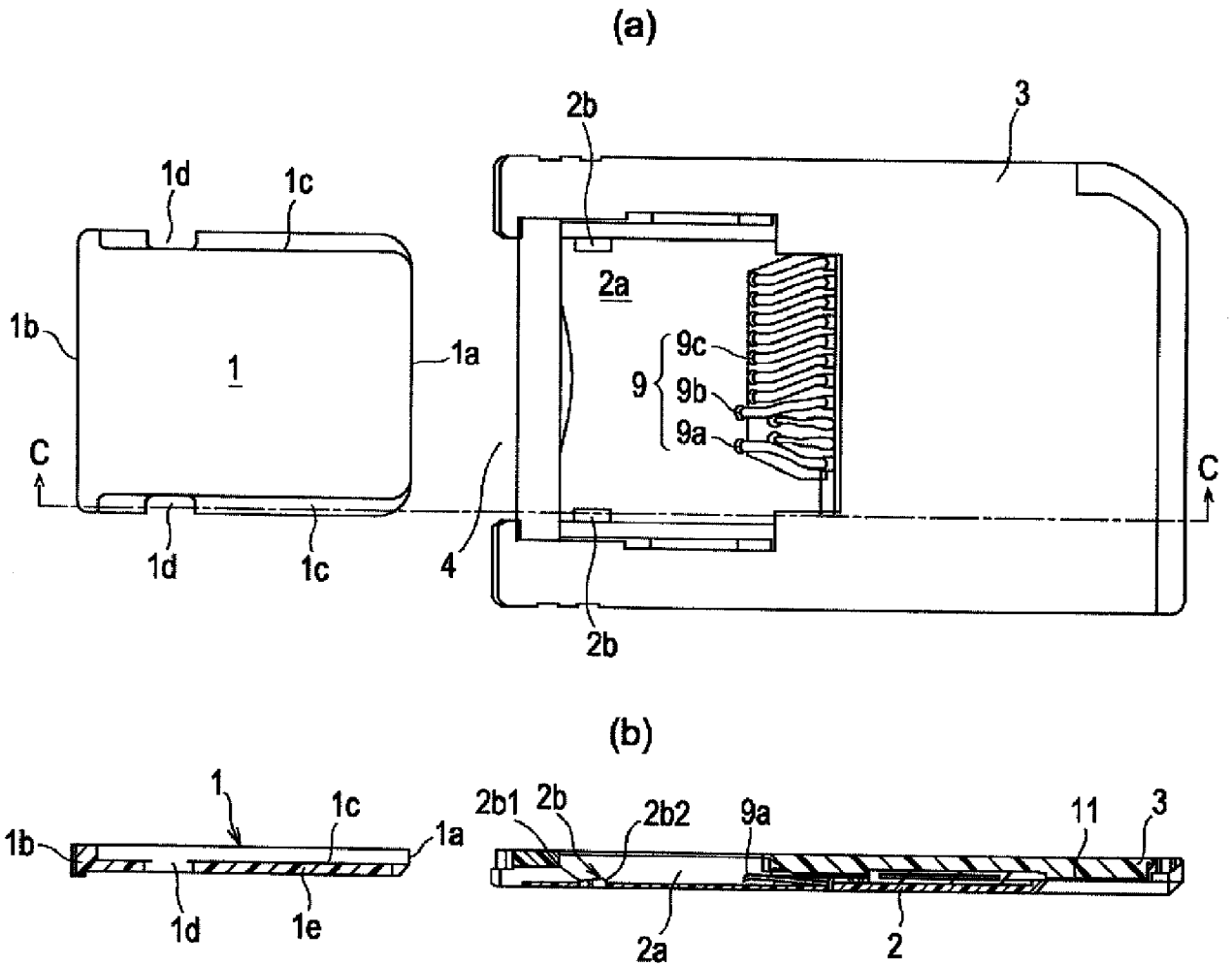
FIG. 5 includes part (a) which is a plan view showing a state where the cover member is removed from the state shown in part (a) of FIG. 4, and part (b) which is a cross-sectional view taken along line C-C in part (a).
Figure 6:
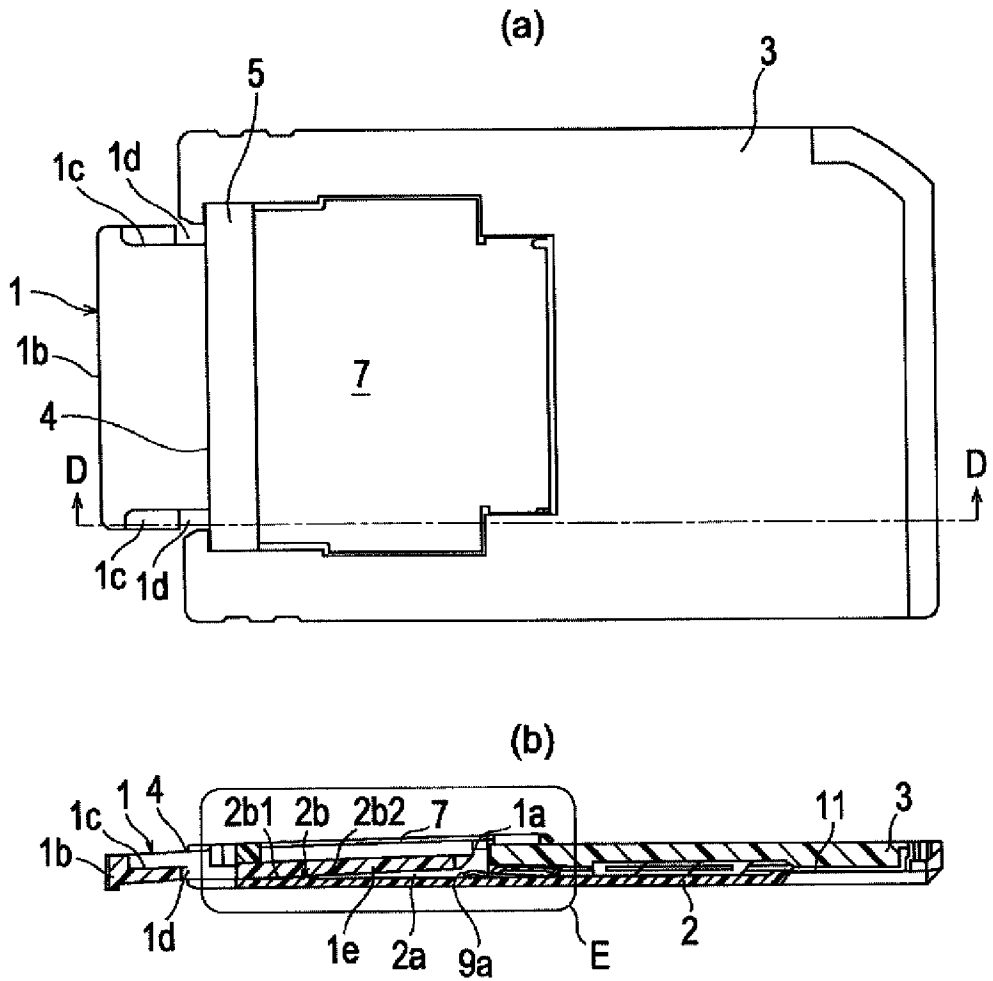
FIG. 6 includes part (a) which is a plan view showing a state where the card is in the process of being inserted into the present embodiment, and part (b) which is a cross-sectional view taken along line D-D in part (a).
Figure 7:
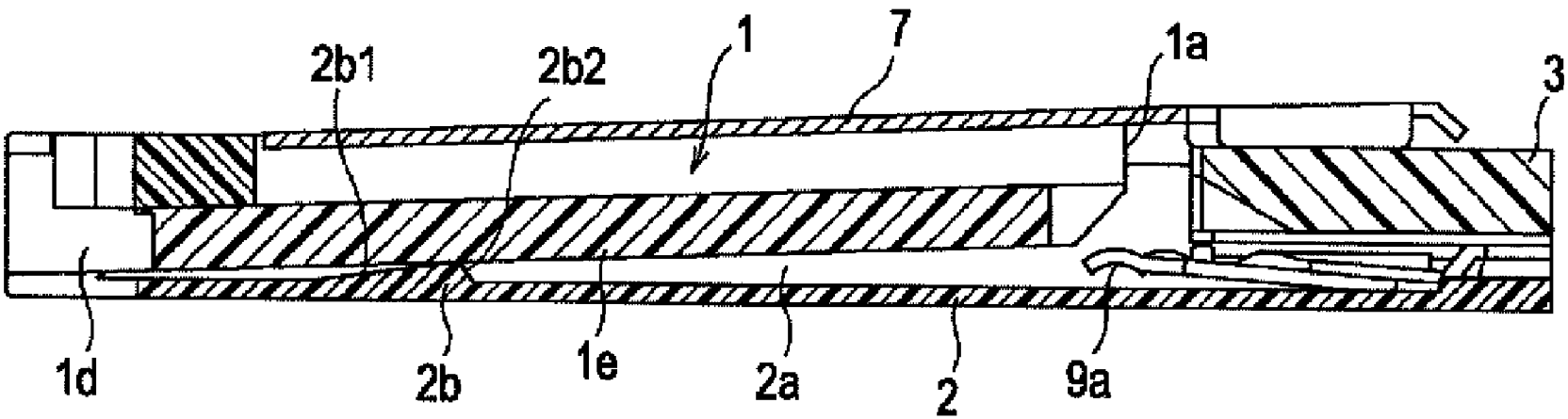
FIG. 7 is an enlarged view of section E in FIG. 6.
Figure 8:
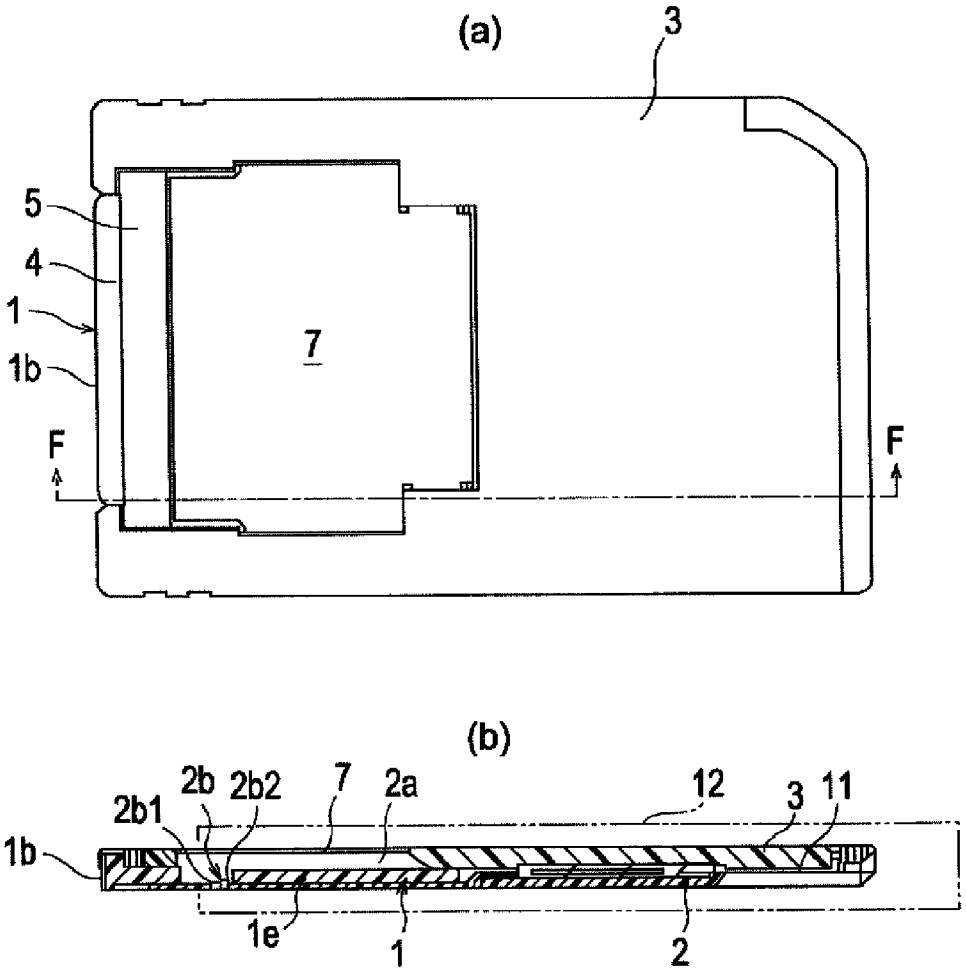
FIG. 8 includes part (a) which is a plan view showing a state where the card held in a holder portion of the present embodiment is locked, and part (b) which is a cross-sectional view taken along line F-F in part (a).

1 card
1*a* anterior end
1*b* end surface
1*c* step portions
1*d* cutouts
1*e* bottom (lifting mechanism)
2 base
2*a* holder portion (connector mechanism)
2*b* protrusions (lifting mechanism)
2*b*1 tapered sections
2*b*2 stopper sections
3 cap
4 insertion slot
5 frame
5*a* shafts
6 guides
7 cover member
7*a* protruding segments
8 insert-molded body
9 terminal member
9*a* ground terminal
9*b* power terminal
9*c* signal terminals
10 spring segments
11 external connection terminals
12 connector device (restricting means)

The invention claimed is:

1. A card connector mechanism comprising a holder portion for holding a card having an external connection portion on a bottom thereof, and a cantilevered terminal member supported at a posterior end thereof, wherein the external connection portion of the card is contactable with the terminal member, wherein the card connector mechanism further comprises a lifting mechanism that temporarily lifts up an anterior end of the card to an upward lifted state and defining an inserting end thereof during insertion of the card so as to prevent the anterior end from abutting on the terminal member, and then releases the upward lifted state to bring the external connection portion of the card into contact with the terminal member.

2. The card connector mechanism according to claim 1, wherein the card has cutouts on opposite side edges thereof, wherein the lifting mechanism includes protrusions provided on left and right sides of a bottom surface of the holder portion, and opposite side edges of the bottom of the card, and wherein, during insertion of the card, the opposite side edges of the bottom of the card abuts on the protrusions so that the anterior end of the card is lifted upward, the anterior end subsequently moving downward as a result of engagement between the cutouts of the card and the protrusions so that the external connection portion of the card comes into contact with the terminal member.

3. A card adapter comprising the card connector mechanism according to claim 1.

4. The card adapter according to claim 3, wherein the terminal member includes a ground terminal, wherein the card adapter further comprises a metallic cover member that is vertically movable and covers the card held in the holder portion, and a metallic spring segment that biases the cover member downward, and wherein the metallic spring segment is connected to the ground terminal.

5. The card adapter according to claim 4, wherein the cover member moves upward against a bias force of the spring segment in response to the upward lifting of the anterior end of the card.

6. The card connector mechanism according to claim 2, wherein each of the protrusions has a tapered section at a side thereof proximate to an insertion slot, and a stopper section at a side thereof proximate to an interior of the mechanism, the stopper section being inclined at a sharper angle than an inclined angle of the tapered section.

* * * * *